US008831253B2

(12) United States Patent
Liou et al.

(10) Patent No.: US 8,831,253 B2
(45) Date of Patent: Sep. 9, 2014

(54) ELECTROACOUSTIC APPARATUS WITH OPTICAL ENERGY CONVERSION FUNCTION

(75) Inventors: Chang-Ho Liou, Changhua County (TW); Ming-Daw Chen, Hsinchu (TW); Yi-Jen Chan, Taoyuan County (TW); Kun-Chia Wu, Taichung County (TW); Winny Wang, Taipei County (TW)

(73) Assignee: Industrial Technology Research Institute, Hsinchu (TW)

( * ) Notice: Subject to any disclaimer, the term of this patent is extended or adjusted under 35 U.S.C. 154(b) by 301 days.

(21) Appl. No.: 12/909,840

(22) Filed: Oct. 22, 2010

(65) Prior Publication Data

US 2011/0255719 A1 Oct. 20, 2011

(30) Foreign Application Priority Data

Jul. 15, 2010 (TW) ..... 99123272

(51) Int. Cl.
*H04R 19/01* (2006.01)

(52) U.S. Cl.
USPC ..... 381/191; 381/150; 381/190; 381/152

(58) Field of Classification Search
USPC ..... 381/190, 191, 82, 334, 431, 150, 152
See application file for complete search history.

(56) References Cited

U.S. PATENT DOCUMENTS

| | | | | |
|---|---|---|---|---|
| 4,352,961 | A * | 10/1982 | Kumada et al. | 455/350 |
| 4,597,099 | A * | 6/1986 | Sawafuji | 381/190 |
| 6,661,563 | B2 * | 12/2003 | Hayashi et al. | 359/296 |
| RE40,860 | E | 7/2009 | Billson et al. | |
| 2009/0016552 | A1 | 1/2009 | Medley et al. | |
| 2009/0245547 | A1 * | 10/2009 | Lee et al. | 381/191 |
| 2010/0027814 | A1 * | 2/2010 | Chen et al. | 381/150 |
| 2010/0092010 | A1 | 4/2010 | Lee | |
| 2010/0166247 | A1 | 7/2010 | Lee | |

FOREIGN PATENT DOCUMENTS

| | | |
|---|---|---|
| JP | 03-030526 | 2/1991 |
| JP | 2009-117888 | 5/2009 |
| JP | 2010-118909 | 5/2010 |
| TW | 201014369 | 4/2010 |

* cited by examiner

*Primary Examiner* — Brian Ensey
*Assistant Examiner* — Sabrina Diaz
(74) *Attorney, Agent, or Firm* — Jianq Chyun IP Office

(57) ABSTRACT

An electroacoustic apparatus with an optical energy conversion function is provided. The electroacoustic apparatus includes an optical energy converter for converting optical energy into electrical power. The electroacoustic apparatus further includes a signal generator and a flat speaker. The signal generator receives a signal from a sound source and generates a sound signal according to the received signal. The signal generator sends the sound signal to the flat speaker, and the flat speaker makes a sound according to the sound signal. Aforementioned operations are all performed by using the electrical power generated by the optical energy converter or a power stored therein.

12 Claims, 14 Drawing Sheets

ELECTROACOUSTIC APPARATUS WITH OPTICAL ENERGY CONVERSION FUNCTION

CROSS-REFERENCE TO RELATED APPLICATION

This application claims the benefit of U.S. Provisional Application No. 61/254,110, filed Oct. 22, 2009. This application also claims the priority benefit of Taiwan patent application serial no 99123272, filed Jul. 15, 2010, now pending. The entirety of the above-mentioned patent applications is hereby incorporated by reference herein and made a part of this specification.

BACKGROUND

1. Technical Field

The disclosure generally relates to an electroacoustic apparatus, and more particularly, to an electroacoustic apparatus with an optical energy conversion function.

2. Technical Art

Flexible electronics is a rapidly developing technology for mounting electronic devices on flexible or conformal substrates made of thin plastic or metal foils. Flexible electronics can be broadly applied, and the applications of flexible electronics can be generally categorized into replacement applications and innovative applications.

In a replacement application, a conventional electronic device is replaced with a flexible electronic device by taking such factors as the appearance, cost, and performance of the product into consideration. For example, flexible displays, flexible e-books, RFIDs, and flexible solar batteries are the major replacement products that are currently being developed. An innovative application, as its name implies, is an unconventional application, in which non-electronic applications (for example, textiles, upholstery, toys, and gifts) of a flexible electronic product are developed according to the characteristics (for example, the flexibility) of the flexible electronic product different from those of any conventional rigid electronic device.

SUMMARY

An electroacoustic apparatus is introduced herein.

In one of embodiments, an electroacoustic apparatus with an optical energy conversion function is provided. The electroacoustic apparatus includes an optical energy converter for converting optical energy into electrical power. The electroacoustic apparatus further includes a signal generator and a flat speaker. The signal generator receives a signal from a sound source and generates a sound signal according to the received signal. The signal generator sends the sound signal to the flat speaker, and the flat speaker makes a sound according to the sound signal. Foregoing operations are all performed by using the electrical power generated by the optical energy converter or power stored therein.

According to an embodiment, the flat speaker includes a metal electrode with a plurality of holes, an electret vibrating film structure, and supporting members arranged according to the design.

Several embodiments accompanied with figures are described in detail below to further describe the disclosure in details.

BRIEF DESCRIPTION OF THE DRAWINGS

The accompanying drawings are included to provide further understanding, and are incorporated in and constitute a part of this specification. The drawings illustrate embodiments and, together with the description, serve to explain the principles of the disclosure.

DETAILED DESCRIPTION OF DISCLOSED EMBODIMENTS

Figure 1:
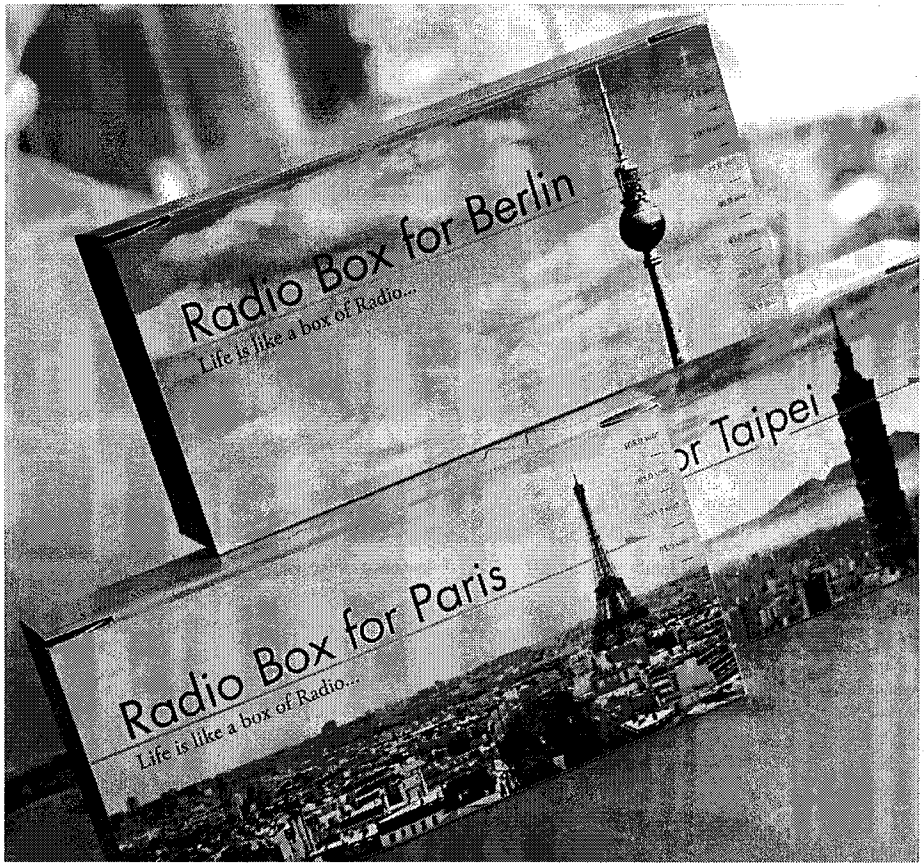
FIG. 1 is a diagram of an electroacoustic apparatus according to an embodiment of the disclosure.

An embodiment provides an electroacoustic apparatus with an optical energy conversion function. The electroacoustic apparatus includes an optical energy converter for converting optical energy into electrical power. The electroacoustic apparatus further includes a signal generator and a flat speaker. The signal generator receives a signal from a sound source and generates a sound signal according to the received signal. The signal generator sends the sound signal to the flat speaker, and the flat speaker makes a sound according to the sound signal. Foregoing operations are all performed by using the electrical power generated by the optical energy converter or power stored therein.

In an embodiment, the flat speaker includes a metal electrode with a plurality of holes, an electret vibrating film structure, and supporting members arranged according to the design. In an embodiment, the electret vibrating film structure includes an electret film layer and a metal thin film electrode.

The optical energy converter includes a photovoltaic material which can convert optical energy into electrical power, in which the photovoltaic material may be a solar battery or a photosensitive dye material battery made of silicon or other semiconductor materials. However, the photovoltaic material may also be made of other non-semiconductor materials. When the photovoltaic material is a solar battery made of silicon, the photovoltaic material may be made of poly silicon, single crystal silicon, or amorphous silicon based on the application environment thereof. To be specific, if the photovoltaic material is used indoors, the photovoltaic material may be made of amorphous silicon so that lights emitted by indoor light sources (for example, fluorescent lamps and table lamps) can be converted into electrical power, and if the photovoltaic material is used outdoors, the photovoltaic material may be made of single crystal silicon or amorphous silicon so that the light emitted by the sun can be converted into electrical power. In a photosensitive dye material solar battery, TiO2 colloidal solution is evenly coated on a transparent ITO conductive glass, wherein the TiO2 electrode layer is porous therefore can absorb dye. When the dye absorbed by the TiO2 electrode layer is optically excited, the electrons transit from the original ground state to an excited state. Because the energy level of the excited electrons exceeds that of the TiO2 conduction band, the electrons in the dye are injected into the TiO2 conduction band and conducted to an external circuit. When the electrons reach the cathode, a reduction reaction happens between the electrons and the iodic complex ions in the electrolyte to produce iodic ions. The oxidized dye molecules are reduced by the iodic ions in the electrolyte into ground-state molecules. Thus, a circulatory and uninterrupted route is formed within the entire solar battery, and even an entire photosensitive dye material battery can be used repeatedly.

In an embodiment, the flat speaker includes a metal electrode with a plurality of holes, an electret vibrating film structure, and supporting members arranged according to the design. Because the electrical power utilization rate of the flat speaker is five to ten times of that of a general moving coil speaker, the signal generator can drive the flat speaker by using the electrical power generated by the optical energy converter. In other words, the optical energy converter alone can be served as the driving power source of the flat speaker. Thereby, using the flat speaker is made very convenient.

In an embodiment of the disclosure, the signal generator, the flat speaker, and the optical energy converter of the electroacoustic apparatus are thin, light, and flexible therefore can be mass fabricated through a roll to roll process on a large scale. Because the optical energy converter can convert optical energy into electrical power for the flat speaker, the demand of mains electricity or battery can be effectively reduced or eliminated and the purpose of energy saving and carbon reduction can be realized. Accordingly, future product applications can be made more extensive, energy-efficient, and environment-friendly.

An embodiment of the disclosure provides an electroacoustic apparatus. The electroacoustic apparatus includes a signal generator, a flat speaker, and an optical energy converter. The signal generator, the flat speaker, and the optical energy converter may be disposed on the same substrate. However, the disclosure is not limited thereto. It may also be that the flat speaker and the optical energy converter are disposed on the substrate while the signal generator is included in another chip. Or, it may also be that the signal generator, the flat speaker, and the optical energy converter are respectively disposed on different substrates.

FIG. 1 is a diagram of an electroacoustic apparatus according to an embodiment of the disclosure. Referring to FIG. 1, the electroacoustic apparatus in the embodiment may be a radio box flexio. A radio box flexio is a paper-packaged radio with an optical energy conversion function, and patterns can be printed on the low-cost packaging thereof. The radio box flexio is customizable, attractive, and low-cost, and which may also receive online radio through wireless networks (WiFi or WiMax).

A consumer can buy a radio box flexio, such as the "Radio Box for Berlin", the "Radio Box for Paris", or the "Radio Box for Taipei" in FIG. 1, as a gift for a friend. A Taipei resident can buy a radio box flexio with the pattern of "Radio Box for Taipei" for a friend. A radio box flexio will be an unforgettable present.

Based on the concept of city marketing, tourists can collect radio box flexio of different cities. With different cities, different packaging designs, and different radio music, the radio box flexio brings a whole new radio listening experience and a very different shopping experience.

Figure 2A:
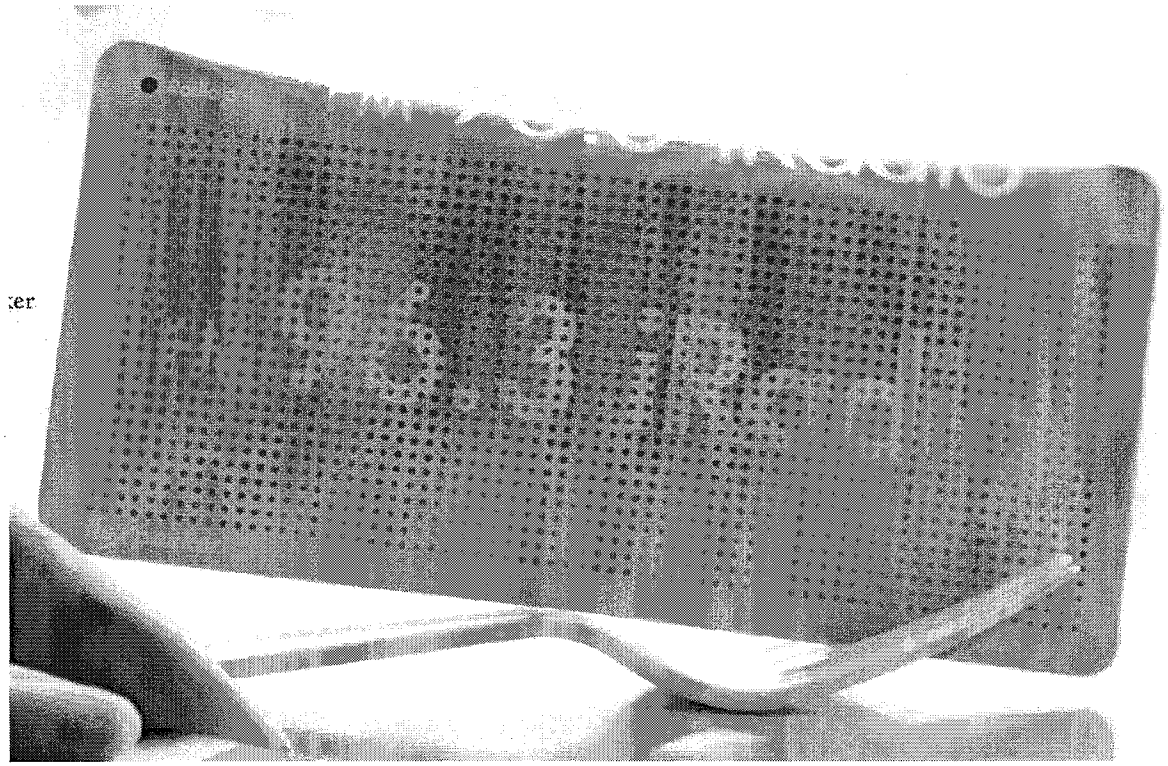
FIG. 2A is a diagram of an electroacoustic apparatus according to another embodiment of the disclosure.

FIG. 2A is a diagram of an electroacoustic apparatus according to another embodiment of the disclosure. Referring to FIG. 2A, the electroacoustic apparatus in the embodiment may be a radio box flexio printed with the frequency of a radio station. The object for supporting the radio box flexio may have any structure. For example, a spoon can be used for supporting the radio box flexio when the user is enjoying a cup of coffee in a coffee shop. The optical energy converter (for example, a solar battery) in the radio box flexio can convert solar light or indoor light into electrical power, and the flat speaker in the radio box flexio can play radio programs by using the electrical power supplied by the optical energy converter.

The owner of a radio station can print advertisements on the packages of radio boxes. The owner of a radio station can customize single-pack radio boxes and make the radio boxes to receive only a specific radio station. A consumer may select his favourite channel and purchase a single-pack flexio. Or, the consumer may also purchase a pack of four flexios and establish an exclusive ration station collection.

Figure 2B:
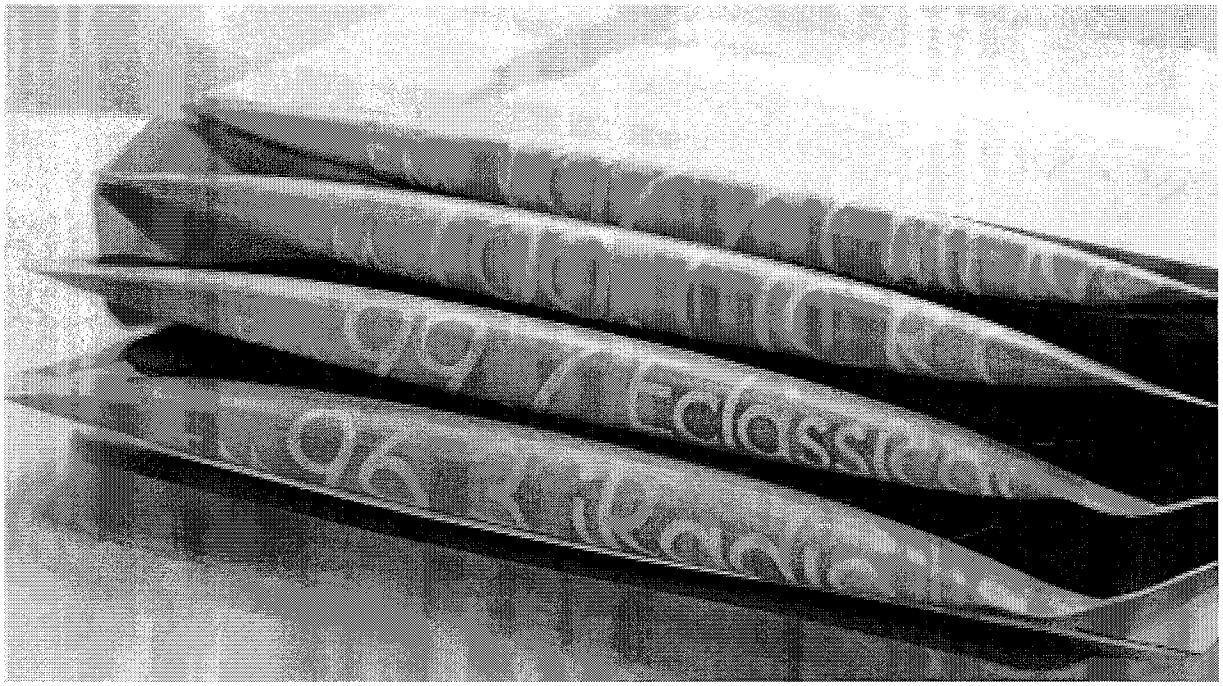
FIG. 2B is a diagram of an electroacoustic apparatus according to another embodiment of the disclosure.

FIG. 2B is a diagram of an electroacoustic apparatus according to another embodiment of the disclosure. Referring to FIG. 2B, the electroacoustic apparatus in the embodiment may be a pack of four radio box flexios printed with the frequencies of radio stations. The pack of four radio box flexios will sure be an unforgettable present.

Radio station information is printed on the surface of each radio box flexio and is easily noticed by a user. These four radio stations may be a collection of favourite radio stations of the user, and these four radio box flexios may be given to different friends.

In addition, an office worker can enjoy beautiful music by attaching a radio box flexio on the window. This interesting and new experience can completely sweep away the boredom of office work.

While enjoying a cup of coffee along with a favourite novel in an outdoor coffee shop on a Sunday afternoon, a user can place a radio box flexio on the table and enjoy beautiful music instantly. The radio box flexio, along with the aromatic latte, makes the relaxing time even more perfect. Regardless of where the user is (in the office, the coffee shop, or any other place), the favourite radio station is with him/her everywhere. In short, the radio box flexio brings beautiful music and happiness into every corner of the user's daily life.

Figure 3:
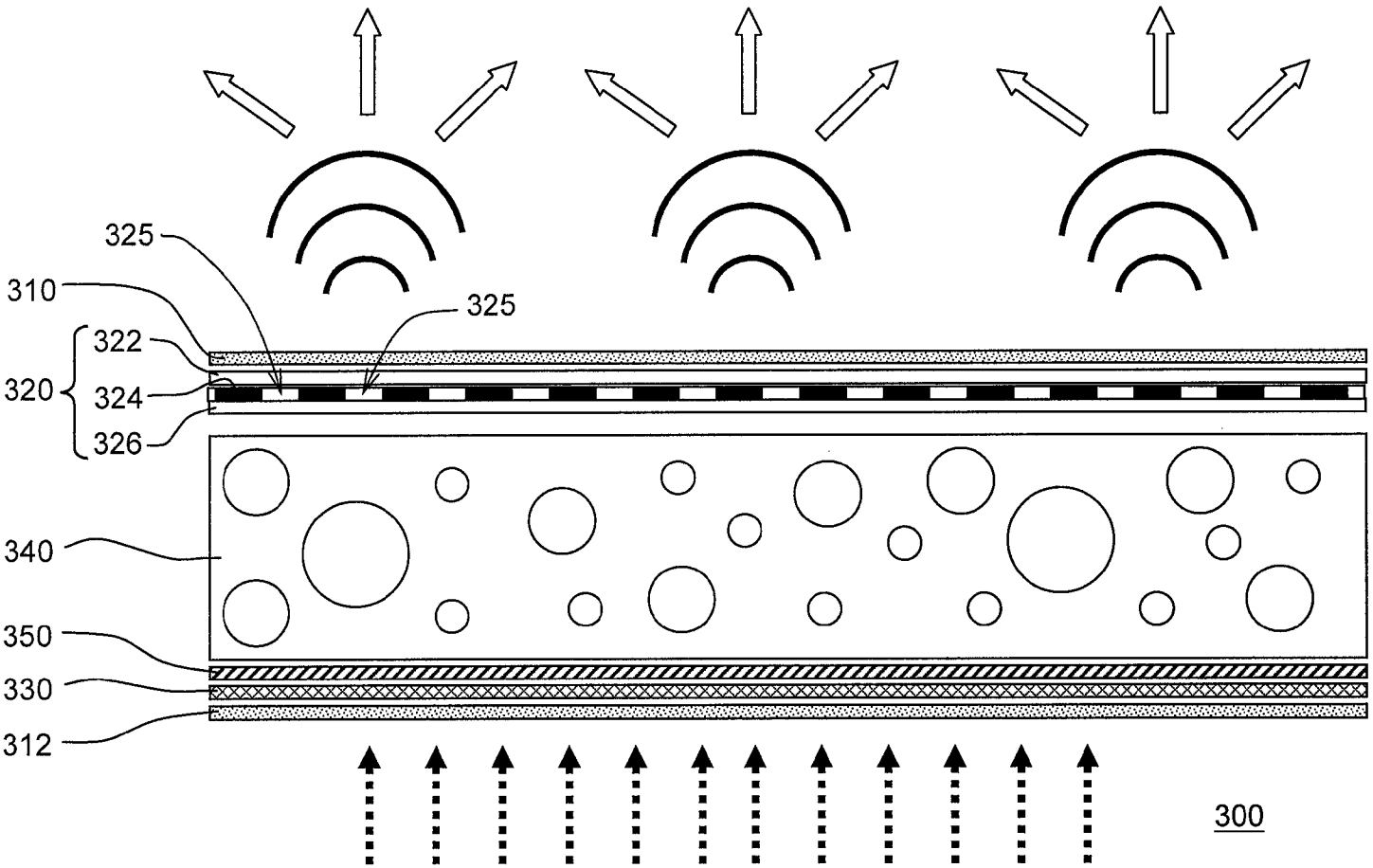
FIG. 3 is a cross-sectional view illustrating the structure of an electroacoustic apparatus according to an embodiment of the disclosure.

FIG. 3 is a cross-sectional view illustrating the structure of an electroacoustic apparatus according to an embodiment of the disclosure. Referring to FIG. 3, the electroacoustic apparatus 300 includes a flat speaker 320, an optical energy converter 330, and a signal generator 350.

In the embodiment, the flat speaker 320, the optical energy converter 330, and the signal generator 350 are stacked together layer by layer. To be specific, the flat speaker 320, the optical energy converter 330, and the signal generator 350 are all disposed at both sides of the electroacoustic apparatus 300 as multiple layers so as to achieve the paper-packaged or fabric-packaged box design. Such disposition allows patterns to be printed on the exterior surface and the manufacturing cost to be reduced so that the electroacoustic apparatus can be mass manufactured. In other words, the electroacoustic apparatus 300 in the embodiment can be designed to have a multilayer structure according to the actual requirement.

For example, as shown in FIG. 3, the layer of the signal generator 350 is disposed beside the layer of the optical energy converter 330. However, the disclosure is not limited thereto, and the layer of the signal generator 350 may also be disposed beside the layer of the flat speaker 320. In the embodiment, the signal generator 350 is disposed between the flat speaker 320 and the optical energy converter 330. In other embodiments, the flat speaker 320, the optical energy converter 330, and the signal generator 350 may also be disposed in different chips.

The optical energy converter 330 may be a solar battery made of single crystal silicon, poly silicon, or amorphous silicon. The optical energy converter 330 converts solar light or indoor light into electrical power and supplies the electrical power to the flat speaker 320 and the signal generator 350. When solar light or the light beams emitted by other light sources reaches the optical energy converter 330 of the electroacoustic apparatus 300, the optical energy converter 330 converts the optical energy into electrical power. Accordingly, the optical energy converter 330 can efficiently generate electricity even when it is placed indoors. In other words, the electroacoustic apparatus 300 can work normally in an indoor environment.

The signal generator 350 operates by using the electrical power supplied by the optical energy converter 330. The signal generator 350 includes a signal receiver and a sound signal generator. The signal generator 350 receives a signal from a signal source and generates at least one sound signal for the flat speaker 320 according to the received signal. For example, the signal generator 350 receives a radio signal and provides a sound signal to the flat speaker 320. Or, the signal generator 350 may be a music player, such as a MPEG-1 audio layer 3 (MP3) player. The flat speaker 320 plays music or a radio program according to the sound signals generated by the signal generator 350.

Additionally, the electroacoustic apparatus 300 in the embodiment further includes a filling 340. The filling 340 may be cotton or other material and may be disposed between the flat speaker 320 and the signal generator 350. The filling 340 can enhance the sound effect of the flat speaker 320. The thickness of the electroacoustic apparatus 300 is determined by the filling 340, and the filling 340 makes the thickness of the electroacoustic apparatus 300 similar to that of a teabag.

In the embodiment, the flat speaker 320 of the electroacoustic apparatus 300 has a stacked structure composed of a metal electrode 322 with a plurality of holes, supporting members 324 arranged according to the design, and an electret vibrating film structure 326. A chamber 325 is formed between the metal electrode 322 and the electret vibrating film structure 326, and an optimal sympathetic vibration effect is achieved through the supporting members 324 arranged in a pre-designed pattern. In an embodiment, the electret vibrating film structure 326 includes an electret film layer 327 and a metal thin film electrode 328.

In the embodiment, the electroacoustic apparatus 300 further includes protection layers 310 and 312 covering a part of an outer surface thereof. The protection layers 310 and 312 may be two pieces of paper or plastic. The protection layers 310 and 312 may be used for covering the optical energy converter 330 or the flat speaker 320 or as the casing of the electroacoustic apparatus 300.

Figure 4:
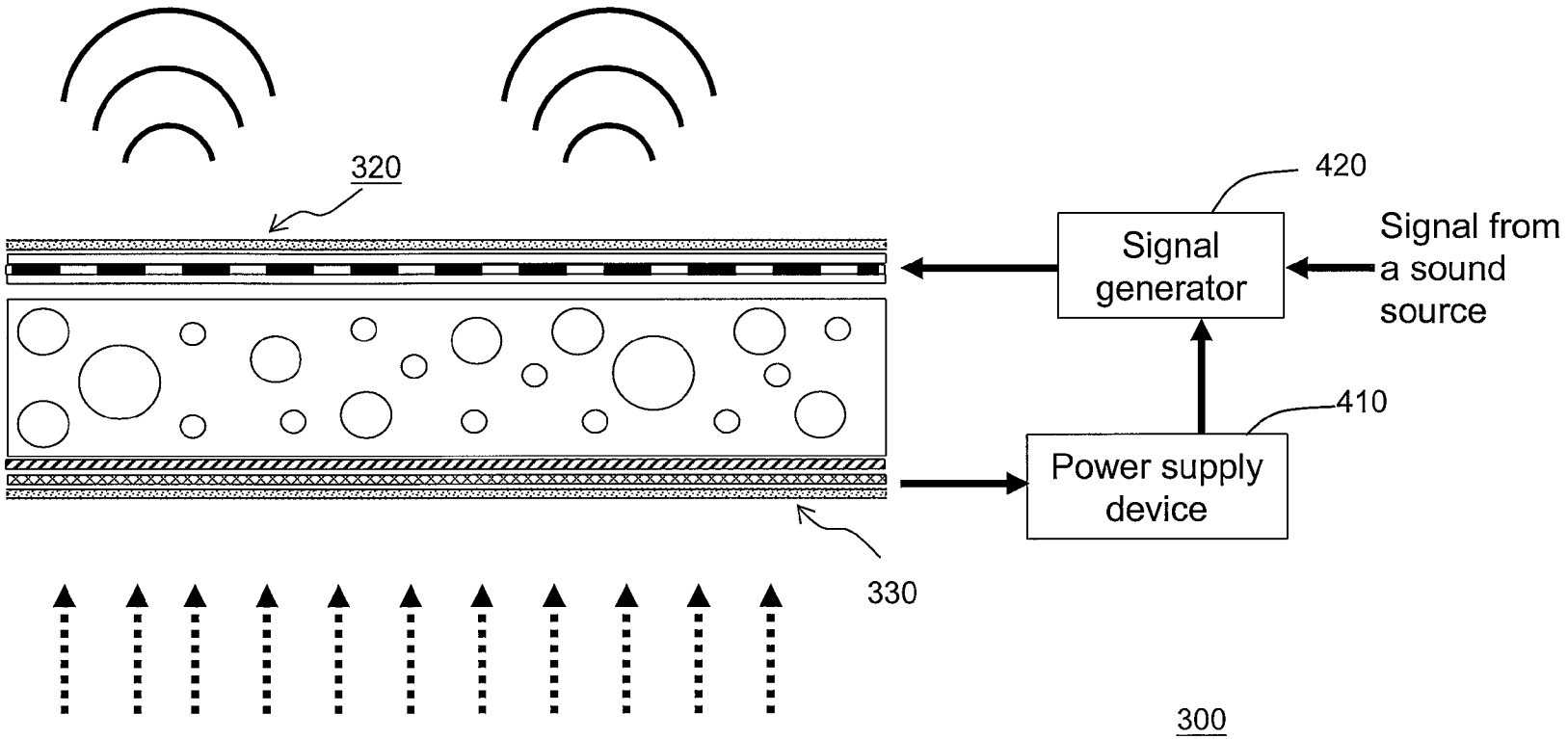
FIG. 4 is a diagram of an electroacoustic apparatus according to another embodiment of the disclosure.

FIG. 4 is a diagram of an electroacoustic apparatus according to another embodiment of the disclosure. Referring to FIG. 4, the electroacoustic apparatus 300 includes a flat speaker 320, an optical energy converter 330, a power supply device 410, and a signal generator 420.

The optical energy converter 330 may be disposed at the same side or a different side as the flat speaker 320 of the electroacoustic apparatus 300. The power supply device 410 is coupled to the optical energy converter 330. The signal generator 420 is coupled to the power supply device 410. The flat speaker 320 is coupled to the signal generator 420. The power supply device 410 receives the power supplied by the optical energy converter 330 and supplies a stable power to the signal generator 420. The signal generator 420 receives radio frequency (RF) signals from a radio station and generates sound signals for the flat speaker 320 by using the stable power supplied by the power supply device 410. Or, the signal generator 420 may be a music player, such as a MP3 player. Because the electrical power utilization rate of the flat speaker 320 is five to ten times of that of a general moving coil speaker, the signal generator 420 can drive the flat speaker 320 by using the electrical power supplied by the optical energy converter 330. In other words, the optical energy converter 330 alone can be served as the driving power source of the flat speaker 320. Accordingly, using the electroacoustic apparatus is made very convenient.

Figure 5:
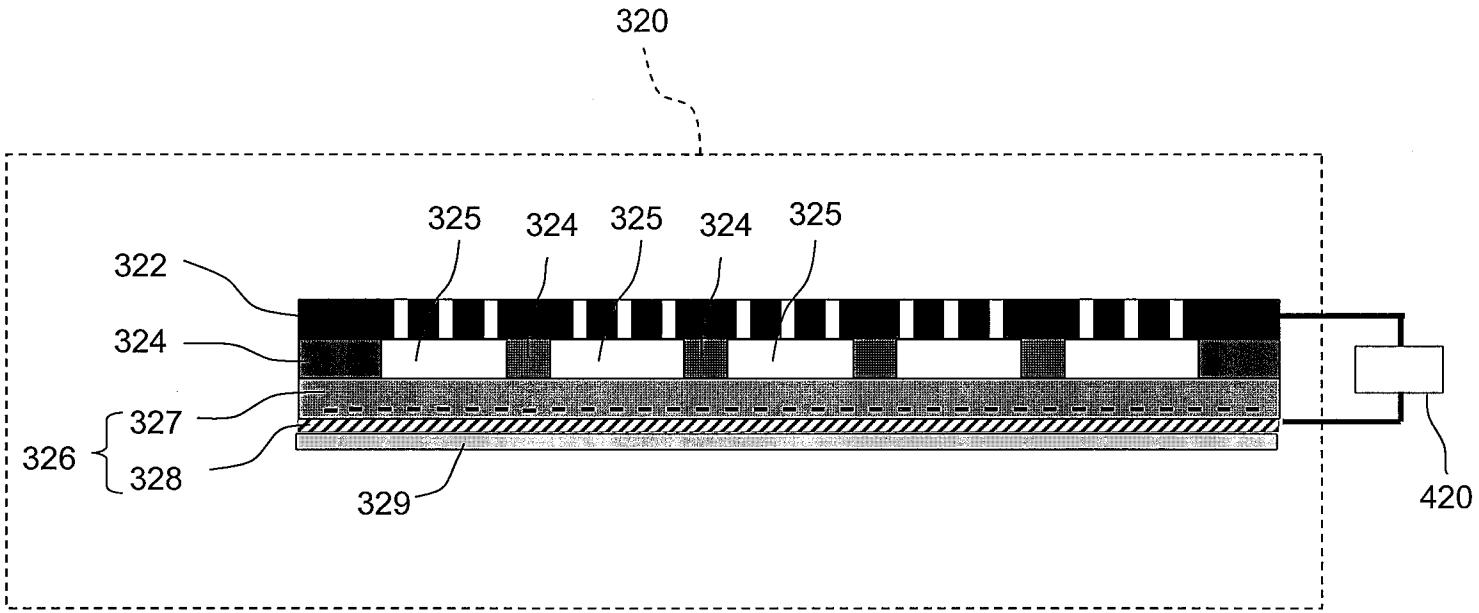
FIG. 5 is a cross-sectional view illustrating a portion of an electroacoustic apparatus according to another embodiment of the disclosure.

FIG. 5 is a cross-sectional view illustrating a portion of an electroacoustic apparatus according to another embodiment of the disclosure. Referring to FIG. 5, a portion of the electroacoustic apparatus 300 is illustrated and described herein. This portion includes a flat speaker 320 and a signal generator 420. The flat speaker 320 has a stacked structure composed of a metal electrode 322 with a plurality of holes, supporting members 324 arranged according to the design, and an electret vibrating film structure 326. A chamber 325 is formed between the metal electrode 322 and the electret vibrating film structure 326, and an optimal sympathetic vibration effect is achieved through the supporting members 324 arranged in a pre-designed pattern. In an embodiment, the electret vibrating film structure 326 includes an electret film layer 327 and a metal thin film electrode 328.

Herein the operation of the portion of the electroacoustic apparatus will be described by assuming that the electret film layer 327 is filled with negative charges. The sound signals generated by the signal generator 420 are respectively input into the metal electrode 322 with the holes and the metal thin film electrode 328. When a sound signal input into the metal electrode 322 is positive or negative, an attractive force or a repulsive force is produced between the sound signal and a negative charge in the electret film layer 327. Accordingly, the metal electrode 322 and/or the electret vibrating film structure 326 vibrate vertically and compress the surrounding air to make a sound.

The metal electrode 322 is made of a conductive material. In an embodiment, metal electrode 322 may also be fabricated by coating a metal film on the surface of a flexible material (for example, paper or an ultrathin non-conductive material). The chamber 325 is disposed between the metal electrode 322 and the electret vibrating film structure 326. The layout, height, and shape of the supporting members 324 disposed in the chamber 325 may affect the sound effect of the flat speaker 320.

The electret film layer 327 may be made of a dielectric material. The dielectric material is electrized therefore can retain static charges for a long time, and an electret effect can be achieved within the dielectric material after charging the dielectric material.

The electret film layer 327 is made of one or multiple layers of dielectric material. The dielectric material may be fluorinated ethylenepropylene (FEP), polytetrafluoethylene (PTFE), polyvinylidene fluride (PVDF), fluorine polymers, or other suitable materials. The dielectric material contains micron- or nano/micro-sized pores.

The electret film layer 327 made of dielectric material is electrized therefore can retain static charges for a long time and offer an electret effect, and the micron- or nano/micro-sized pores therein can enhance the light transmittance and the electret effect. Thus, dipolar charges are produced in the dielectric material after the dielectric material is charged, so that the electret effect is achieved.

In order not to affect the tensile force and vibration of the electret vibrating film structure 326, the metal thin film electrode 328 is designed to be an ultrathin metal thin film electrode. Herein "ultrathin" refers to a thickness between 0.2 micrometer (μm) and 0.80 millimeter (mm), preferably, between 0.2 μm and 0.4 μm. For example, the thickness of the metal thin film electrode 328 is 0.3 μm.

In addition, the electroacoustic apparatus 300 may further include a protection layer 329. The protection layer 329 prevents oxidation of the metal thin film electrode 328. Thus, after forming the metal thin film electrode 328, the protection layer 329 is usually formed on the metal thin film electrode 328 to ensure that the route for supplying sound signals is coupled to the metal thin film electrode 328.

The electret film layer 327 may be filled with positive charges or negative charges. The signal generator 420 is respectively coupled to the metal electrode 322 and the metal thin film electrode 328. The electret film layer 327 drives the metal thin film electrode 328 to vibrate together according to the charges filled therein and the sound signals, so as to compress the surrounding air and make sounds.

Figure 6:
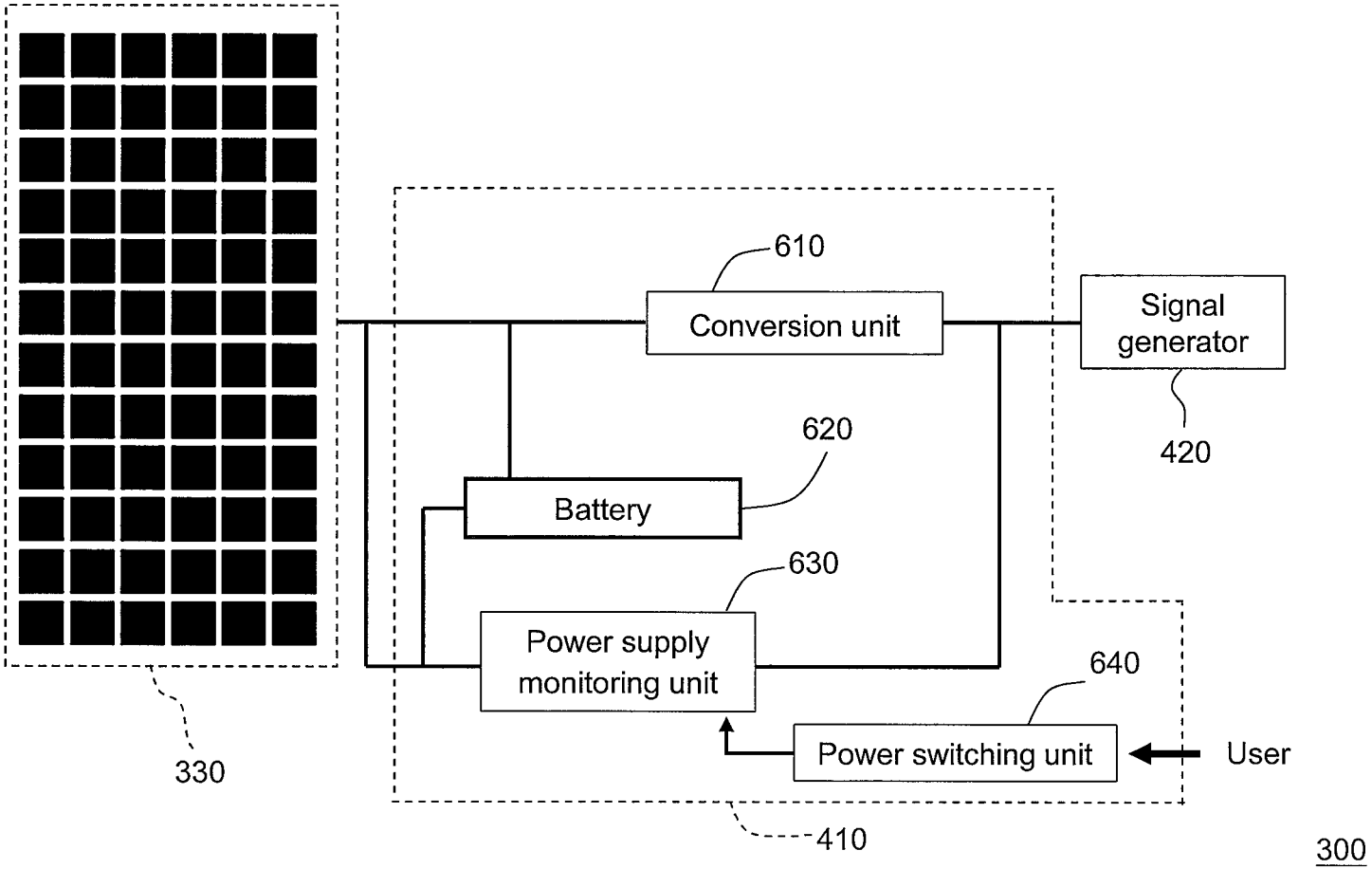
FIG. 6 is a block diagram illustrating a portion of an electroacoustic apparatus according to an embodiment of the disclosure.

FIG. 6 is a block diagram illustrating a portion of an electroacoustic apparatus according to an embodiment of the disclosure. Referring to FIG. 6, only a portion of the electroacoustic apparatus 300 is illustrated, and this portion includes an optical energy converter 330, a power supply device 410, and a signal generator 420.

The optical energy converter 330 has a receiving panel array which can collect energy from a lamp, the sun, an indoor light source, or an outdoor light source. The power supply device 410 receives the power generated by the optical energy converter 330 and supplies a stable power to the signal generator 420. The signal generator 420 receives radio signals and generates sound signals for a flat speaker (not shown) by using the stable power supplied by the power supply device 410. Or, the signal generator 420 may be a music player, such as a MP3 player. Because the electrical power utilization rate of the flat speaker (not shown) is five to ten times of that of a general moving coil speaker, the signal generator 420 can drive the flat speaker (not shown) by using the electrical power generated by the optical energy converter 330. Thereby, using the electroacoustic apparatus is made very convenient.

If there is not any unit for storing power in the power supply device 410, a user may cover the side of the electroacoustic apparatus having the optical energy converter 330 to turn on or off the electroacoustic apparatus by shielding the optical energy converter 330 from light irradiation.

In an embodiment, the power supply device 410 includes a conversion unit 610, a battery 620, a power supply monitoring unit 630, and a power switching unit 640. The conversion unit 610 is coupled to the optical energy converter 330 and the signal generator 420. The battery 620 is coupled to the conversion unit 610. The power supply monitoring unit 630 is coupled to the battery 620, the optical energy converter 330, and the signal generator 420. The power switching unit 640 is coupled to the power supply monitoring unit 630.

The conversion unit 610 converts the electrical power generated by the optical energy converter 330 into a stable power and supplies the stable power to the signal generator 420. The battery 620 supplies a battery power to the signal generator 420 through the conversion unit 610. The battery 620 may be a rechargeable battery, such as a lithium battery. When the stable power or the battery power received by the signal generator 420 is overloading, the power supply monitoring unit 630 turns off the signal generator 420. The power switching unit 640 allows a user to manually turn on or off the signal generator 420.

Figure 7A:
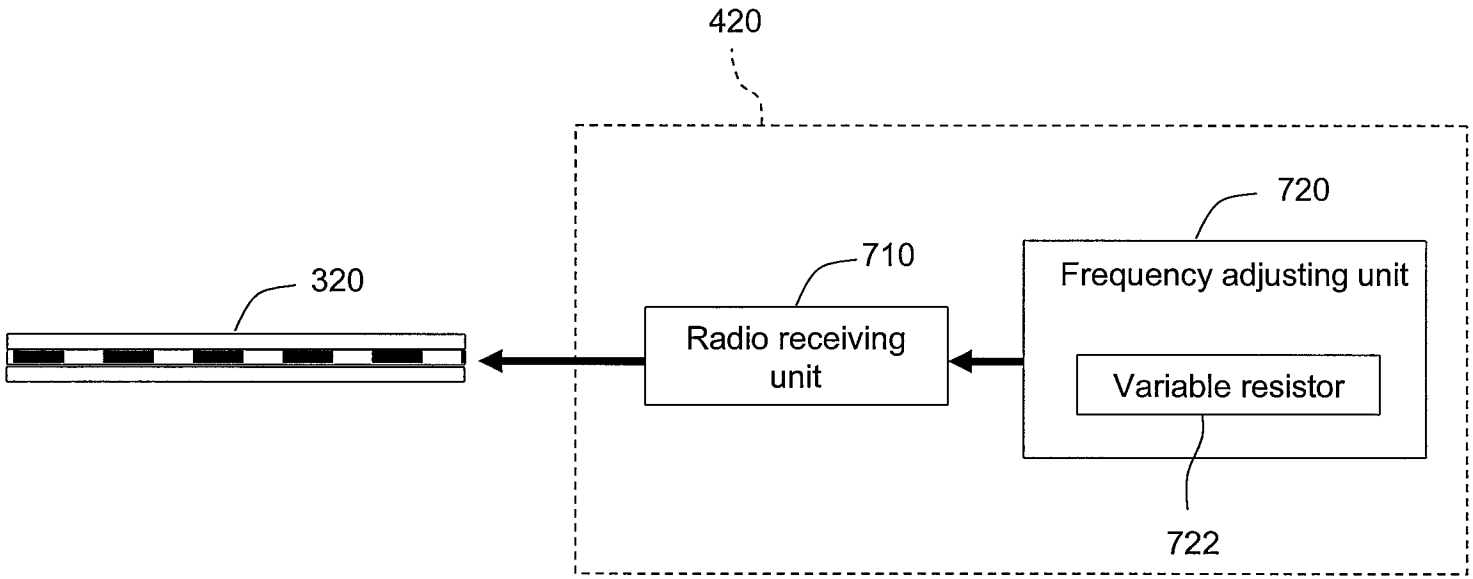
FIG. 7A and FIG. 7B are block diagrams illustrating a portion of an electroacoustic apparatus according to an embodiment of the disclosure.
Figure 7B:
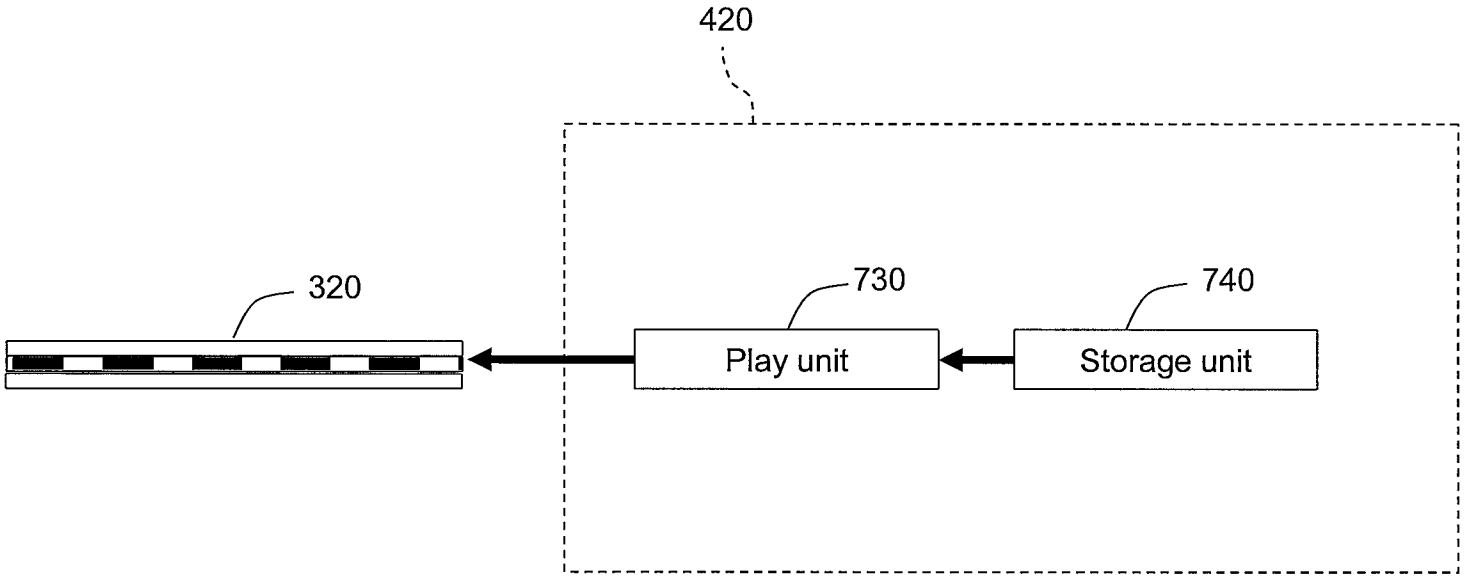

FIG. 7A and FIG. 7B are block diagrams illustrating a portion of an electroacoustic apparatus according to an embodiment of the disclosure. Referring to FIG. 7A, only a portion of the electroacoustic apparatus 300 is illustrated, and this portion includes a flat speaker 320 and a signal generator 420. The signal generator 420 includes a radio receiving unit 710 and a frequency adjusting unit 720. The radio receiving unit 710 is coupled to the frequency adjusting unit 720. The flat speaker 320 is coupled to the radio receiving unit 710.

The radio receiving unit 710 receives radio signals from a radio station, wherein the radio receiving unit 710 receives radio signals of a single frequency. In another embodiment, the frequency adjusting unit 720 includes a variable resistor 722, and a user can adjust the variable resistor 722 to change the frequency of the radio signals received by the radio receiving unit 710 so that the radio receiving unit 710 can receive radio signals of different frequencies. In yet another embodiment, the radio receiving unit 710 receives radio signals from the Internet or a wireless communication system (for example, WiFi or WiMax). The radio receiving unit 710 generates corresponding sound signals according to the received radio signals. The flat speaker 320 provides a radio program according to the sound signals generated by the radio receiving unit 710.

Referring to FIG. 7B, a portion of the electroacoustic apparatus 300 is illustrated herein, and this portion includes a flat speaker 320 and a signal generator 420. The signal generator 420 includes a play unit 730 and a storage unit 740. The play unit 730 is coupled to the storage unit 740. The flat speaker 320 is coupled to the play unit 730.

The storage unit 740 stores sound information, and which may be a non-volatile memory, such as a flash memory. The play unit 730 accesses and generates other sound information stored by music suppliers or supplied by the user. The sound signals generated by the play unit 730 may be sound data of customized songs, music, or advertisements. The flat speaker 320 plays sounds according to the sound signals generated by the play unit 730.

Figure 8A:
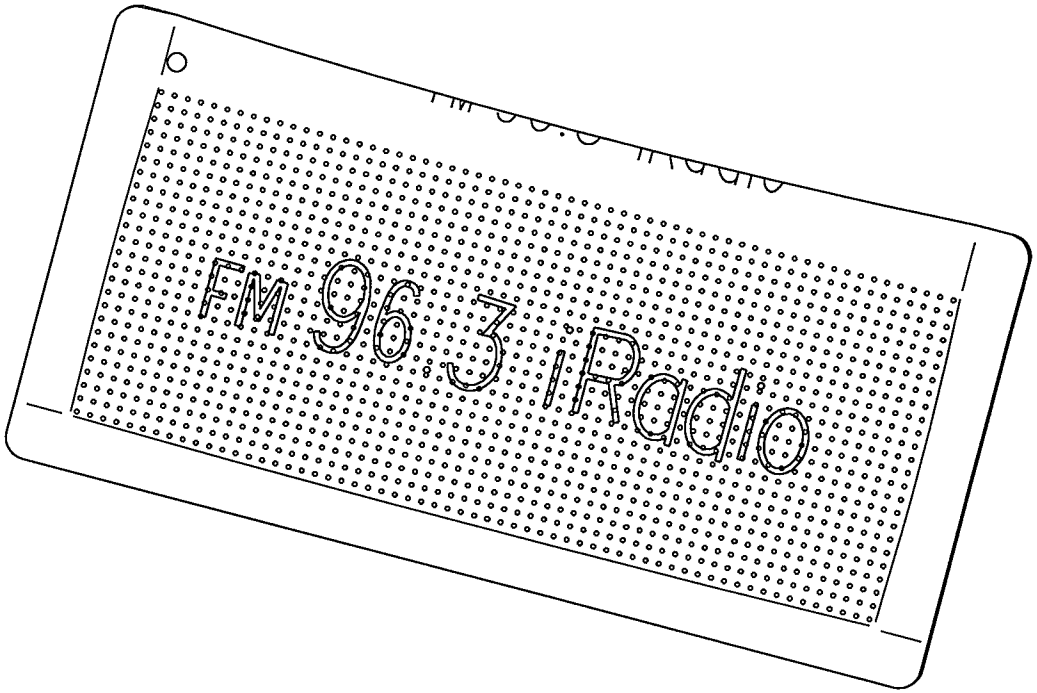
FIGS. 8A-8G are diagrams illustrating an electroacoustic apparatus from different viewing angles according to an embodiment of the disclosure.
Figure 8B:
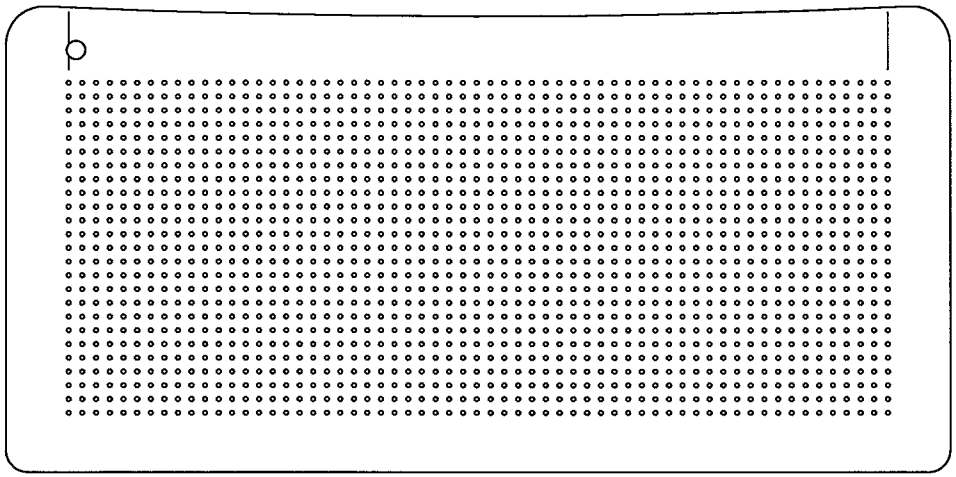
Figure 8C:
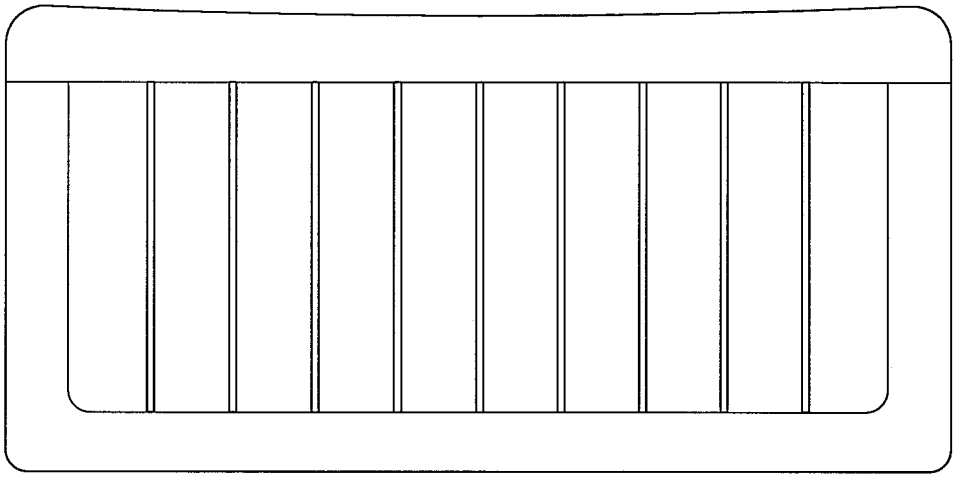
Figure 8D:
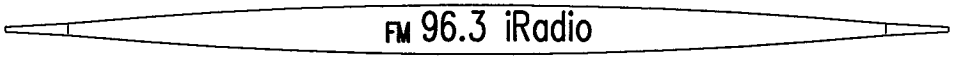
Figure 8E:
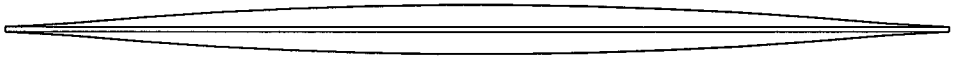
Figure 8G:
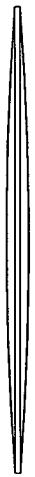
Figure 8F:
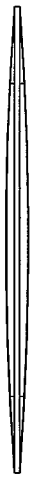

FIGS. 8A-8G are diagrams illustrating an electroacoustic apparatus from different viewing angles according to an embodiment of the disclosure. Referring to FIG. 8A, the frame of the electroacoustic apparatus enhances the esthetical curves, wherein the curves may bent inwards or outwards. Referring to FIGS. 8D-8G, the two ends of the electroacoustic apparatus are thinner, while the middle part thereof is thicker. Accordingly, the electroacoustic apparatus presents a teabag shape as illustrated in FIG. 2.

In summary, an embodiment of the disclosure provides an electroacoustic apparatus including a flat speaker, a solar battery, and a sound signal generator. The sound signal generator drives the flat speaker by using the electrical power generated by the solar battery, so that using the electroacoustic apparatus is made very convenient. In an embodiment of the disclosure, the flat speaker, the solar battery, and the sound signal generator of the electroacoustic apparatus are light, thin, and flexible therefore can be mass manufactured through a roll to roll process on a large scale.

It will be apparent to those skilled in the art that various modifications and variations can be made to the structure of the disclosed embodiments without departing from the scope or spirit of the disclosure. In view of the foregoing, it is intended that the disclosure cover modifications and variations of this disclosure provided they fall within the scope of the following claims and their equivalents.

What is claimed is:

1. An electroacoustic apparatus, comprising:

a flat speaker, disposed on a first side surface of the electroacoustic apparatus, comprising a metal electrode with a plurality of holes and an electret vibrating film structure, wherein a chamber is formed between the metal electrode and the electret vibrating film structure, and a sympathetic vibration is generated in the chamber to make a sound through interaction between the metal electrode and the electret vibrating film structure;

an optical energy converter, flatly disposed on a second side surface of the electroacoustic apparatus, for converting a light beam into an electrical power; and a signal generator, coupled to the optical energy converter and the flat speaker, for receiving a signal from a sound source and generating a corresponding sound signal according to the received signal for driving the flat speaker by using the electrical power, wherein the flat speaker further comprises a plurality of supporting members disposed in the chamber between the metal electrode and the electret vibrating film structure, wherein the electret vibrating film structure includes an electret film layer and a metal thin film electrode, and the sound signals generated by the signal generator are respectively input into the metal electrode and the metal thin film electrode, the electret film layer drives the metal thin film electrode to vibrate together according to the sound signals, wherein the plurality of supporting members arranged in a pre-defined pattern between the metal electrode and the electret film layer of the electret vibrating film structure enhances the sympathetic vibration generated through the interaction between the metal electrode and the electret vibrating film structure.

2. The electroacoustic apparatus according to claim 1, wherein the flat speaker, the optical energy converter, and the signal generator are disposed as stacked layers so as to allow the electroacoustic apparatus to have a flexible feature.

3. The electroacoustic apparatus according to claim 2, wherein the signal generator is disposed between the flat speaker and the optical energy converter.

4. The electroacoustic apparatus according to claim 3 further comprising a filling disposed between the flat speaker and the signal generator.

5. The electroacoustic apparatus according to claim 1 further comprising a protection layer disposed on the first side surface and the second side surface of the electroacoustic apparatus, wherein the protection layer covers the optical energy converter and the flat speaker.

6. The electroacoustic apparatus according to claim 1, wherein the optical energy converter comprises a photovoltaic material for converting optical energy into electrical power.

7. The electroacoustic apparatus according to claim 6, wherein the photovoltaic material is amorphous silicon for converting ambient light into electrical power.

8. The electroacoustic apparatus according to claim 6, wherein the photovoltaic material is single crystal silicon or amorphous silicon for converting solar light into electrical power.

9. The electroacoustic apparatus according to claim 1 further comprising a power supply device, wherein the power supply device receives the electrical power generated by the optical energy converter and supplies a stable power to the signal generator.

10. The electroacoustic apparatus according to claim 9, wherein the power supply device comprises:

a conversion unit, coupled to the optical energy converter and the signal generator, for converting the electrical power generated by the optical energy converter into the stable power and supplying the stable power to the signal generator;

a battery, coupled to the conversion unit and the optical energy converter, for storing the electrical power generated by the optical energy converter and supplying a battery power to the signal generator through the conversion unit;

a power supply monitoring unit, coupled to the battery, the optical energy converter, and the signal generator, for controlling supply of the stable power or the battery power; and a power switching unit, coupled to the power supply monitoring unit, for controlling the power supply monitoring unit to start or stop supplying the stable power or the battery power to the signal generator.

11. The electroacoustic apparatus according to claim 1, wherein the signal generator comprises:

a radio receiving unit, for receiving a radio signal from a radio station to generate the corresponding sound signal; and a frequency adjusting unit, for adjusting a frequency of the radio signal received by the radio receiving unit.

12. The electroacoustic apparatus according to claim 11, wherein the signal generator comprises:

a storage unit, for storing an sound information; and a play unit, for accessing the sound information in the storage unit to generate the corresponding sound signal.

* * * * *

UNITED STATES PATENT AND TRADEMARK OFFICE

CERTIFICATE OF CORRECTION

PATENT NO. : 8,831,253 B2
APPLICATION NO. : 12/909840
DATED : September 9, 2014
INVENTOR(S) : Chang-Ho Liou et al.

It is certified that error appears in the above-identified patent and that said Letters Patent is hereby corrected as shown below:

On the title page, insert --(60) Related U.S. Application Data
Provisional application No. 61/254,110, filed on Oct. 22, 2009.--.

Signed and Sealed this
Sixteenth Day of August, 2016

Michelle K. Lee

Michelle K. Lee
*Director of the United States Patent and Trademark Office*